United States Patent [19]

Heller et al.

[11] 4,171,059

[45] Oct. 16, 1979

[54] STACKABLE LOADING PLATFORM

[75] Inventors: Karl H. Heller, Gehrden; Dieter Schiron, Hanover, both of Fed. Rep. of Germany

[73] Assignee: Continental Gummi-Werke Aktiengesellschaft, Hanover, Fed. Rep. of Germany

[21] Appl. No.: 921,943

[22] Filed: Jul. 5, 1978

[30] Foreign Application Priority Data

Jul. 6, 1977 [DE] Fed. Rep. of Germany ..... 2730445

[51] Int. Cl.[2] ..... B65D 7/00; B65J 1/02; B65D 9/34

[52] U.S. Cl. ..... 220/4 F; 206/600; 220/1.5; 217/65; 206/511

[58] Field of Search ..... 206/600, 511, 512; 220/1.5, 4 F, 75, 76, 77, 4 R, 4 A, 73, 74; 217/12 R, 13, 65, 43 R, 43 A

[56] References Cited

U.S. PATENT DOCUMENTS

| | | | |
|---|---|---|---|
| 2,326,700 | 8/1943 | Swingle et al. | 217/65 |
| 2,549,509 | 4/1951 | Munroe | 217/65 X |
| 2,920,781 | 1/1960 | Butcher et al. | 220/1.5 X |
| 3,401,814 | 9/1968 | Chiswell et al. | 220/4 F |
| 3,958,713 | 5/1976 | Selz | 220/19 X |

*Primary Examiner*—Steven M. Pollard
*Attorney, Agent, or Firm*—Becker & Becker, Inc.

[57] ABSTRACT

A stackable loading platform having a bottom with a plurality of feet. A plurality of supports are respectively located at the feet and are detachably arranged therein. A plurality of side walls are arranged between and detachably engage the respective adjacent supports. The side walls, in the corner regions of their upper edges, are positively connected to the supports. The supports are selectively movable in the longitudinal direction thereof away from the bottom for removing the supports from the platform. In the region of the feet, rigid stops are associated with the platform for securing the lower portion of the side walls against inward movements.

3 Claims, 3 Drawing Figures

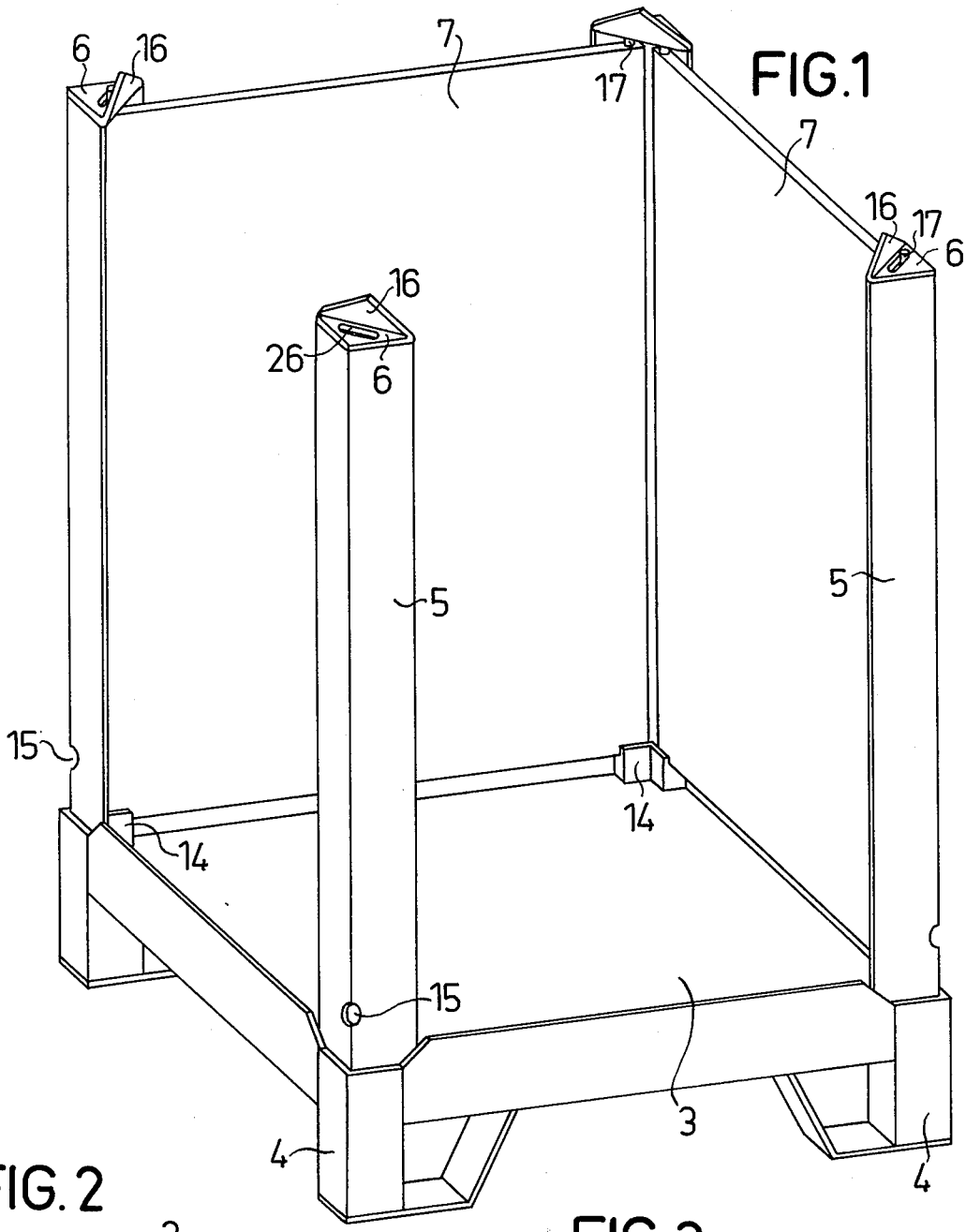
FIG.1
FIG.2
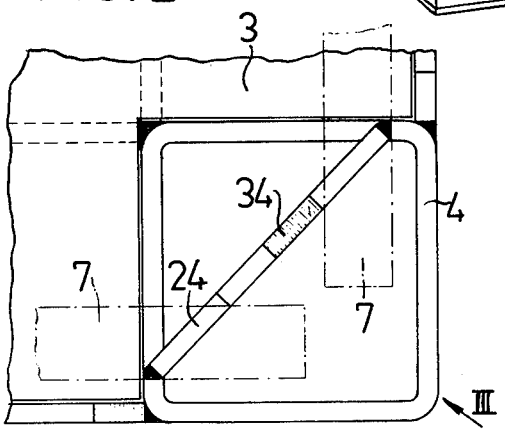
FIG.3
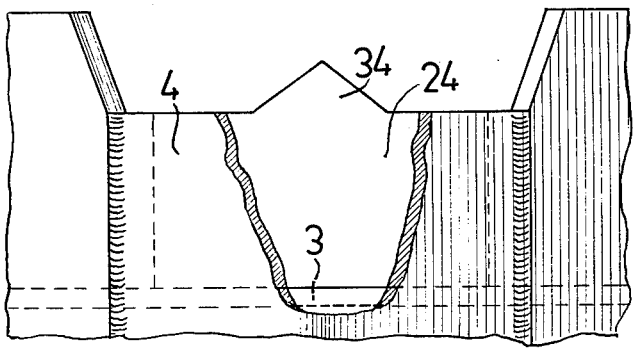

STACKABLE LOADING PLATFORM

The present invention relates to stackable loading stands or platforms provided with supports which are detachably inserted in tube-like open feet and which serve to receive a further loading platform. The loading platform is further provided with side walls which engage the insides of the supports and are positively connected with the supports in the upper corner regions of the side walls (see applicant's U.S. copending application Ser. No. 855,929, filed Nov. 29, 1977).

The object of the loading platform or pallet of the above mentioned patent application is to detachably mount the side walls on the supports in a quick and easy manner so as to form a reliable positive connection and to be able to selectively convert the loading platform from one form into the other form so as to be able to use the loading platform with or without the side walls at the least possible expense. The means provided for connecting the side walls in the region of their free upper corners with the supports fulfills all transport and storage conditions occurring in practice. However, the security of the adopted completed storage by the static pressure of the loaded goods is not always assured. This is particularly the case when the loading platforms are empty, i.e., when, under the effect of the vibrations which occur during transport, the properly inserted side walls deflect inwardly. In extreme cases, the side walls can become detached from their upper mountings.

It is, therefore, an object of the present invention to avoid the danger of this detaching.

This object and other objects and advantages of the present invention will appear more clearly from the following specification in connection with the accompanying drawings, in which:

FIG. 1 shows part of a loading platform or container pallet of the present invention;

FIG. 2 shows in detail another embodiment of a corner of a loading platform according to the present invention; and FIG. 3 is a side view taken in the direction of the arrow III of FIG. 2.

The loading platform of the present invention is characterized primarily in that, in the region of the feet, the loading platform is provided with rigid stops for securing the side walls against inward movements. The stops may be formed from metal strips which are firmly inserted into the feet. The metal strips diagonally cross the opening of the feet and, at least in the middle of the strips, rise above the loading platform. In this connection, pursuant to a further feature of the present invention, the metal strips are advantageously provided with an upper rim, the end regions of which are aligned with the upper rim of the feet, while the middle region is raised in the form of a triangle. Pursuant to a variation of the present invention, an internal border is provided for the supports in the feet. This internal border, at least in its middle region, is provided with an upper rim which is spaced from the loading platform.

Referring now to the drawings in detail, the loading platform shown in FIG. 1 comprises a rectangular bottom plate 3 with feet 4 arranged at the four corners thereof. The feet 4, which are made of commercial square pipe, serve for resting the loading platform at a distance from the ground or supporting surface, which distance is sufficient to permit the lift forks of a lift truck to reach below the bottom plate 3. At the same time, the feet 4 also serve for loosely inserting the supports 5. The supports 5 consist of angle profiled rolled steel, and the free upper ends of the supports 5 are provided with a welded-on cover 6 for supporting a further loading platform (not shown). To this end, the cover plate 6 has a metal tip 16 which fits into the feet 4 of a loading platform placed thereon. The cover plate 6 is further provided with a slot-shaped longitudinal recess 26 for receiving the pivot or pin shaped mountings 17 provided on the upper rim of the side walls 7. These features, which are associated with the upper mounting of the side walls, form the subject matter of patent application Ser. No. 855,929.

Pursuant to the present invention, the feet 4 are provided with an angular internal border 14 for the supports 5, which border acts as an upward extension of the inner walls of the feet 4. The height of the internal border 14 above the bottom plate 3 of the loading platform is such that the upper rim overlaps at least a good portion of the lower rim of the side walls 7. As a result, the side walls are secured against inward displacements, when in the position of use, from below as well as from above. On the other hand, this securing can again be discontinued by applying a lifting force in bores 15 expediently provided in the supports 5.

In the specific embodiments shown in FIGS. 2 and 3, a metal strip 24 is inserted approximately diagonally in the upper profiled opening of the feet 4, and is connected by a weld. The edges of the upper rim of the metal strip 24 are aligned with the bottom plate 3. The middle of the upper rim of the metal strip 24 is provided with a triangular elevation 34 which extends over the lower rim of the side walls 7, and serves as a stop therefor.

Removal of the side walls for both the embodiments of FIG. 1 and FIGS. 2 and 3 takes place in the same manner. In both instances, two adjacent supports 5 are lifted upwardly out of the feet 4. The thus freed side walls 7 can then be removed.

The present invention is an advantageous complement to the above mentioned patent application Ser. No. 855,929, which provides a positive mounting of the side walls on the supports in the region of the free upper corners of the side walls. With the present invention, independent of the static pressure of the loaded goods, the side walls are also secured against undesirable deflections in the region of their lower rims. Without changing the handling of the side walls during insertion and removal, the novel loading platforms, which are designed as container pallets, can therefore be transported empty as well as filled or partially filled, since every risk of inward displacement of the side walls, and the loosening or detaching of the side walls from their upper mountings, which detaching is made possible as a result of such displacement, is precluded.

The present invention is, of course, in no way limited to the specific showing of the drawings, but also encompasses any modifications within the scope of the appended claims.

What is claimed is:

1. A stackable loading platform having a bottom with a plurality of hollow feet, a plurality of supports respectively located at said feet and detachably arranged therein, and a plurality of side walls arranged between and detachably engaging the respective adjacent supports, said side walls in the corner regions of their upper edges being positively connected to said supports, said supports being selectively movable in the longitudinal direction thereof away from said bottom for removing said supports from said platform, characterized in that rigid stops are associated with said platform in the region of said feet for securing the lower edges of said side walls against inward movements, said stops comprising metal strips respectively firmly inserted into the pertaining feet, said strips extending approximately diagonally across the opening of said feet, at least the middle portion of said strips being raised higher than the level of said platform.

2. A loading platform according to claim 1, in which said metal strips are respectively provided with an upper rim, the end regions of which are aligned with the upper rim of said feet, said raised middle portion of said strips being in the form of a triangle.

3. A loading platform according to claim 1, in which said stop comprises an internal border, at least the middle region of said border being provided with an upper rim which is higher than the level of said platform.

* * * * *